United States Patent [19]

Buser et al.

[11] 4,283,749

[45] Aug. 11, 1981

[54] APPARATUS FOR THE CONTROLLED DISCHARGE OF A CHARGED OBJECT

[75] Inventors: Rudolf G. Buser, Wall; Hans E. Inslerman, Long Branch, both of N.J.

[73] Assignee: The United States of America as represented by the Secretary of the Army, Washington, D.C.

[21] Appl. No.: 78,628

[22] Filed: Sep. 25, 1979

[51] Int. Cl.[3] ..... H05F 3/02

[52] U.S. Cl. ..... 361/218; 361/222

[58] Field of Search ..... 361/216, 217, 218, 219, 361/222; 174/55 G, 6

[56] References Cited

U.S. PATENT DOCUMENTS

| | | | |
|---|---|---|---|
| 1,564,855 | 12/1925 | Jurs | 361/217 X |
| 2,753,491 | 7/1956 | Legge | 174/6 X |
| 3,893,005 | 7/1975 | Corbin | 361/218 X |
| 4,059,846 | 11/1977 | Eisenhauer | 361/218 X |

*Primary Examiner*—Harry E. Moose, Jr.

*Attorney, Agent, or Firm*—Nathan Edelberg; Jeremiah G. Murray; Michael C. Sachs

[57] ABSTRACT

A grounding device for discharging a charged helicopter or the like comprises, in one embodiment, a nylon or Teflon ® stringer having a metal weight at one end and a metal connector at the other. A plurality of spherical, graded resistance conductive ceramic beads and conductive points are strung on the stringer to form a flexible self-cleaning discharge device.

18 Claims, 10 Drawing Figures

APPARATUS FOR THE CONTROLLED DISCHARGE OF A CHARGED OBJECT

GOVERNMENT LICENSE

The invention described herein may be manufactured by or for the government, for governmental purposes, without the payment of any royalties thereon or therefor.

BACKGROUND OF THE INVENTION (a) Field of the Invention

Broadly speaking, this invention relates to methods and apparatus for discharging static electricity. More particularly, in a preferred embodiment, this invention relates to methods and apparatus for discharging the static charge acquired by a moving vehicle, such as a helicopter.

(b) Discussion of the Prior Art

The accumulation of high electrostatic charges on heavy-lift helicopters and the like creates a very hazardous situation for both personnel and cargo during sling, loading operations when the aircraft, of necessity, is hovering close to the ground. The complete loss of the aircraft and its cargo may occur if the loading operation fails.

It is generally accepted that there are two basic mechanisms involved in the natural charging of a helicopter during flight:

(1) *influence* or *inductive charging* caused by the earth's natural electrostatic field with the potential accumulation increasing with altitude, and (2) *triboelectric* or *friction charging* caused by contact with dust, sand, rain, hail or snow particles in the atmosphere or by hydrocarbon particles in the engine exhaust gas stream.

Since loading and unloading is typically performed at altitudes between 10 and 100 feet (3 to 30.5 meters), potential and energy accumulations as high as 150,000 volts and 5 joules are respectively encountered. These energy levels are well above the lethal range, and exemplify the critical need for an effective cargo grounding system for the newer series of large helicopters.

Conversely, under high triboelectric or frictional charging conditions caused by dust, sand and dry snow, similar high electric potentials and energies are encountered, necessitating the design of a practical energy discharge system capable of handling these energies without excessive deterioration under adverse operating conditions, thus minimizing the danger to personnel.

It is, thus, a prime object of the invention to reduce the energy levels encountered by cargo handling personnel to well below the 100 millijoule level. This level itself constitutes a severe shock level and commonly occurs in present day small cargo and personnel transport aircraft. Under ideal laboratory conditions, energies of one millijoule are at the in-vitro, sensation threshold level and 10 to 25 millijoule discharges can be felt by most personnel. Under the extremely turbulent downdraft conditions present beneath a hovering helicopter, much higher energies, not exceeding 25 millijoules, can be tolerated by most personnel. The same conditions exist for sensitive cargo or fuels since the violent air-blast in the rotor vortex flow has a disruptive and deadening effect. (NOTE: 25 millijoules in $1\times10^{-9}$ farads, a typical helicopter capacity at 20 feet, corresponds to 7,070 volts.)

In conjunction with the use of protective clothing and accessories, the prime purpose of the present invention is to prevent any electrical discharge to personnel which would cause them to move involuntarily as a reaction to the shock, in such a manner that the loading operation might be aborted or the cargo handler fall, lose his balance, or otherwise create a condition where he could be injured through falling. Of course, operational personnel are still expected to wear protective clothing consisting of very flexible insulated boots and gloves and coveralls which are impervious to moisture to overcome the psychological hazard of dealing with residual high voltages.

On this basis, a 25 millijoule level would appear adequate to provide a significant reduction in the shocking potential of an aircraft during loading and unloading operations. For a continuous current type discharge through the human body, the sensation threshold level is in the order of 1 mA. Due to the relatively short discharge time, the peak current is higher in a capacitance discharge for the same sensation. Laboratory and field tests have confirmed that when a high resistance is placed in series with the human body, the discharge time of a capacitor increases and the threshold level is then higher than the *continuous current sensation* threshold, which is in the order of 1 mA. This observation forms the basis for the instant solution to the personnel safety problem using the 1 mA current sensation threshold level.

SUMMARY OF THE INVENTION

The problem, then, is to devise a technique for safely and efficiently discharging the static charge acquired by a moving vehicle. The apparatus employed must be inexpensive, light and automatically deployable. Above all, it must be reliable under all types of environmental conditions (e.g. rain, ice, slush, wet snow, mud and caked dust).

The above and other problems have been solved by the instant invention which, in a preferred embodiment, comprises an apparatus for the controlled discharge of a charged object. The apparatus includes a first metallic member for contacting the object to be discharged, a second metallic member for contacting the ground, and a plurality of conductive elements in loose contact one with the other for establishing a resistive discharge path from the first to the second metallic member.

The invention and its mode of operation will be more fully understood from the following detailed description when taken with the appended drawing, in which:

DETAILED DESCRIPTION OF THE INVENTION

Figure 1:
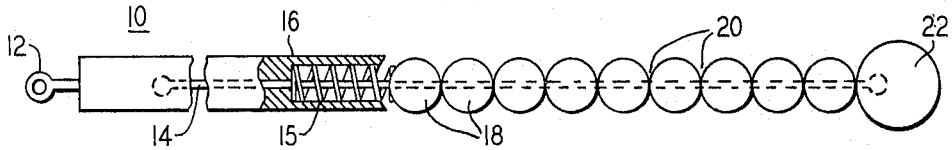
FIG. 1 is a side view of a first illustrative discharge device according to the invention.

FIG. 1 depicts a first illustrative embodiment of the invention. As shown, grounding device 10 comprises a flexible, nonconductive stringer 14 of nylon or Teflon having a heavy metal weight 22 at one end and a rigid metal connector 16 at the other. Advantageously, stringer 14 includes a conductive loop or eye 12 attached to connector 16 for securing the grounding device to some suitable hook or fastener on the helicopter. A plurality of generally spherical conductive ceramic beads 18 are threaded onto stringer 14 to fill the space between weight 22 and connector 16.

Also shown in a phosphor bronze spring 15, to maintain electrical contact between upper metal piece and the first ceramic bead 18. Electrical contact between the remaining beads is assisted by both gravity and the spring (15) pressure. Advantageously, ceramic beads 18 have a graded resistance, and, as shown, form a plurality of cascaded spark-gaps 20 for discharging the static electricity accumulated by the helicopter in flight. The design of grounding device 10 results in a structure which is articulated and ideally suited for deployment from a hovering helicopter, the heavy weight 22 at the end thereof insuring that the device does not flail in the breeze but, rather, makes prompt and positive contact with the earth's surface.

Figure 2:
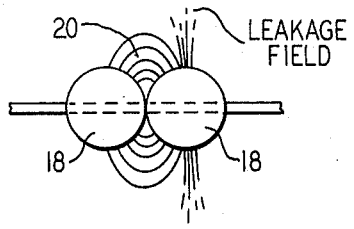
FIG. 2 shows the basic features of the discharge device of FIG. 1 more explicitly.

A unique and novel feature of the invention, shown more explicitly in FIG. 2, is the variation in spherical spark-gap resistance as the corona current increases with potential. The corona current regions 20 constituting a spherical spark-gap between resistive beads 18, expand at higher energy levels providing a variable resistance path for the discharge currents. This feature provides multiple advantages over a fixed resistance discharge device, viz.:

(a) the lowered gap resistance under high voltage conditions reduces the initial discharge time;

(b) dangerous potentials are reduced more rapidly during initial contact period;

(c) the corona leakage field provides an auxiliary leakage path to the atmosphere prior to ground contact;

(d) the discharge device resumes its optimum resistance for steady state conditions after ground contact;

(e) the arrangement provides a means for optimizing the $V_H/I_D$ ratio (helicopter potential/discharge current ratio) to a minimum value, consistent with safety. The $V_H/I_D$ ratio is also a measure of the operational efficiency of comparable discharge devices;

(f) the corona devices (rings, spheres, spark-gaps and wicks) inherently act as protective elements, providing stabilized voltage gradients across many elements in series. Overloading and subsequent burnout of sections is therefore minimized.

Figure 3:
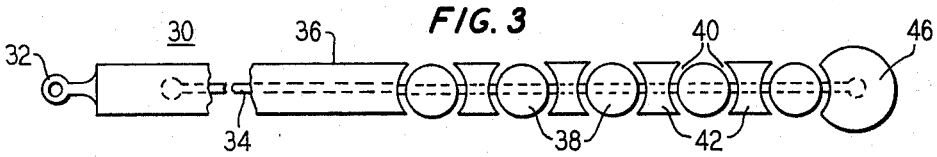
FIG. 3 is a side view of a second illustrative discharge device according to the invention.

FIG. 3 depicts an alternative embodiment of the invention. As shown, grounding device 30 comprises a non-conducting stringer at one end and a heavy metal weight 46 at the other. A plurality of conductive ceramic beads 38 and ventricular metallic spacers 42 alternate along the length of the stringer.

Figure 4:
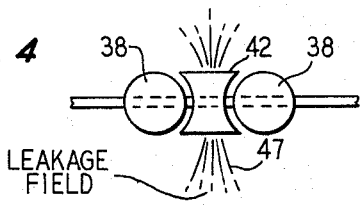
FIG. 4 shows the basic features of the discharge device of FIG. 3 more explicitly.

As shown in FIG. 4, the metallic spacers 42 are optionally provided with flexible, conductive corona points, wicks or brushes 47 (made of wire or conductively plated nylon filaments). As previously explained, in connection with FIG. 2, the primary purpose is to lower the helicopter potential prior to ground contact and in conjunction with the spark-gaps and bead resistances to provide a variable resistance mechanism allowing an initial rapid discharge of helicopter potential. After the initial potential is discharged below the corona limits, the gaps and wicks become inoperative and the discharge device assumes its higher resistance, steady state posture, with currents well below the safe limit in accordance with the formula:

$$i^2t=10^{-7}$$

i—is the discharge current.

t—is the discharge duration in seconds.

As in the previous embodiment, the resultant structure is self-cleaning, articulated and includes a plurality of spark gaps 40 for discharge of the static electricity. If desired, spacers 42 may also be manufactured from a conductive ceramic rather than from metal.

Figure 5:
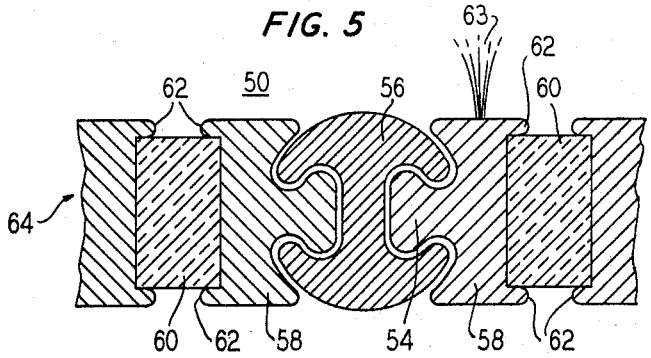

FIG. 5 depicts yet another embodiment of the invention. As shown, grounding device 50 comprises a plurality of conductive ceramic beads or discs 58 each having an extension 54 which is received within a corresponding recess of a rolled metal bead connector 56. Each ceramic disc 58 includes a resistive element 60 which may have differing resistance depending upon the particular application. Again, this third embodiment of the invention is articulated, self-cleaning and includes a plurality of spark-gaps 62 for discharge of static electricity, and brush discharge wicks or points 63 suitably located therealong.

Figure 6:
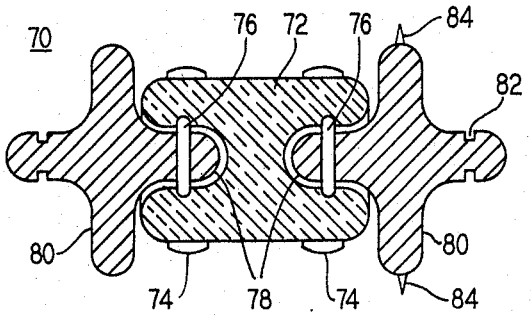
Figure 7:
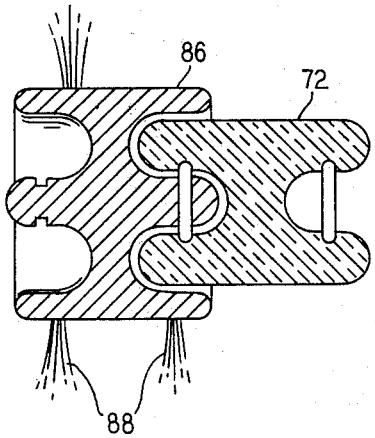

FIG. 6 depicts yet another embodiment of the invention in which a grounding device 70 includes a plurality of metallic corona-ring connectors 80 with discharge points 84 affixed thereto each having a pair of opposing, grooved extensions 78. These extensions, when fitted with a non-conducting, e.g. nylon, snap-ring 76, lock the connectors in corresponding recesses in a plurality of conductive ceramic resistors 72. To relieve stress, resistors 72 are provided with first and second corona ring reinforcements 74. FIG. 7 depicts a variation on the arrangements shown in FIG. 6 wherein the metallic connector 86 is configured as a spark-gap type metal connector rather than a corona ring type connector, with wicks 88. Once again, the grounding device which is formed by cascading a plurality of the sub-assemblies shown in FIGS. 4 or 5 will be flexible, self-cleaning and includes a plurality of spark-gaps and wicks for discharge of the static electricity.

Figure 8:
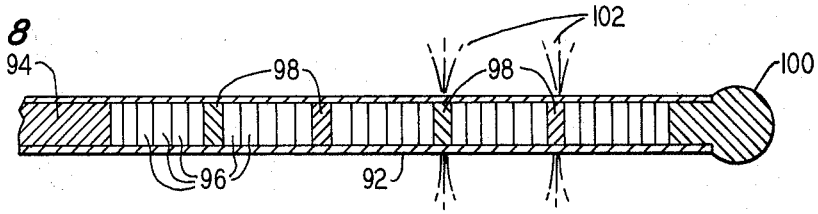
FIGS. 5–8 are cross-sectional views of further alternative embodiments of illustrative discharge devices according to the invention.

FIG. 8 depicts yet another embodiment of the invention in which a grounding device 90 comprises a plurality of conductive ceramic discs 96 and a lesser plurality of metal voltage equalizer discs 98 are sandwiched in a non-conductive plastic, e.g. Teflon, sleeve 92 between a metallic end piece 94 and a metallic end ball 100. In one illustrative embodiment, the sleeve 92 had a ½" O.D., and was from 10 to 25 feet along with one equalizer disc 98, with optionally connected wicks 102, between every 6 ceramic discs. The above-described structure is clearly flexible, but it is not self-cleaning; however, since the conductive discs are protected from the environment by sleeve 92, this is of no consequence.

In operation, the coiled resistive tail or grounding device is fastened to a wheel housing or cargo hook and released by some suitable electrical release mechanism (not shown). When deployed, all of the previously described grounding devices will provide a current drain path between the charged helicopter, the adjacent free space and ground. More specifically, during flight the links of the grounding device are housed in coiled form in a canister with an electrical release which may be controlled by the crewmaster or co-pilot or alternatively automatically deployed by connection to the cargo hook lowering circuit.

In one embodiment actually built and tested, the canister was 6'' in diameter and 1 foot long. The canister was fastened to the lower portion of the helicopter's fuselage, to the rear area of the cargo hook itself or to the helicopter's wheel pylons.

In another embodiment, the full length of the grounding device was lowered from tree-top heights of 75 feet attached to a metallic cable and winch, with a safety release mechanism in the event of snagging or fouling.

The invention is not limited to use with a helicopter but may be used with other aircraft or land vehicles, or indeed, in any situation where harmful or dangerous static buildup must be safely and reliably discharged.

Figure 9:
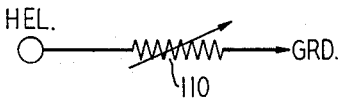
FIGS. 9 and 10 show symbolically the resistance characteristics of the discharge device of this invention in practice, at various stages during flight.
Figure 10:
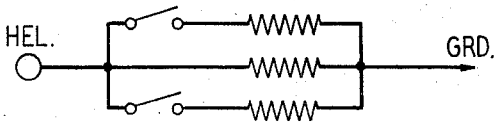

FIGS. 9 and 10 depict symbolically the variable resistance feature of this invention during the aircraft landing phase of operations. Specifically the landing phase consists of two electrical time periods; a transient period immediately before and after ground contact and a steady state discharge period beginning shortly after ground contact is made. As previously explained in connection with FIG. 2 the corona current region 20 between the resistive beads 18, physically constitutes a variable resistance in series with the bead resistance. During forward flight, when the aircraft is charged to a high potential, as the aircraft approaches ground, the voltage stress or gradient in the spherical spark-gap regions rapidly increases, causing a large outward expansion of the corona current breakdown region 20 in FIG.2. The ionized corona region also represents a variable resistance which decreases as the potential increases and is inherently much lower than the normal air resistance between the beads 18. It will also be noted that as the corona region 20 expands radially, the number of parallel, axial current paths between adjacent bead surfaces increases and the total corona region resistance decreases. At the same time the path distance traversed in each bead decreases, resulting in a correspondingly lower bead resistance. The ultimate low limit in total resistance is obtained when there is a complete flashover or voltage breakdown between adjacent beads. Prior to ground contact, the flow of corona or spark-gap leakage currents to the atmosphere are facilitated by the flexible conductive corona points, wicks or brushes shown in FIGS. 2, 4, 5, 7 and 8. It is not to be overlooked, that the in-flight accumulated charge and aircraft potentials are steadily being decreased by the built-in leakage features previously described, resulting in a safer situation for the ground crew prior to touchdown. The combined operation of the variable spark-gap regions and current drain wicks result in the automatic decrease in effective resistance of the discharge devices exemplified by FIGS. 1, 3, 5, 6, 7 and 8.

The transient current decay period continues shortly after ground contact is made with a subsequent collapse of the corona field regions and the return of the grounding device to its original higher resistance, steady state, regime, where the current flows are essentially constant and within safe limits.

In FIG. 10, the variable, series resistance feature of FIG. 9 is represented by a parallel circuit format. The low resistance transient phase is shown symbolically by the two switches closed, with all three resistances in parallel. Shortly after ground contact, the two switches automatically open resulting in the symbolically higher resistance, steady state regime.

It is further noted, that the purposes of this invention can also be achieved electronically, by using well known voltage/current sensitive electronic switching elements to perform the same function as shown symbolically by the switches in FIG. 10 or the variable resistor in FIG. 9. It is also evident to one well versed in the arts that many other configurations of a discharge device comprising a resistive element, an element sensitive to current or voltage connected to a switching element, providing automatically a variable resistance, for the purpose of optimizing the operation of a variable discharge device, is possible within the claims of this invention.

What is claimed is:

1. Apparatus for the controlled discharge of a charged object which comprises:

a first metallic member for contacting the object to be discharged;

a second metallic member for contacting the ground;

a plurality of conductive elements in loose contact one with the other for establishing a resistive discharge path from said first to said second metallic member; and a corresponding plurality of discharge members connected to said conductive elements to provide additional discharge paths to the atmosphere, prior to contact of said apparatus with the ground.

2. Apparatus for the controlled discharge of a charged object, which comprises:

a first metallic member for contacting the object to be discharged;

a second metallic member for contacting the ground;

a plurality of conductive elements in loose contact one with the other for establishing a resistive discharge path from said first to said second metallic member, wherein each of said conductive elements comprises a generally spherical ceramic bead having a graded resistance, the apparatus further comprising:

a non-conductive plastic stringer connected at one end to said first metallic member and at the other end to said second metallic member, said plurality of beads being strung on said stringer to form a flexible, self-cleaning discharge device.

3. The apparatus according to claim 2 further comprising: a plurality of ventricular, metallic spacers respectively interposed between each pair of adjacent ceramic beads thereby to form a cascaded plurality of spark gaps.

4. The apparatus according to either claim 1, 2 or 3 wherein said second metallic member comprises a metal weight.

5. Apparatus for the controlled discharge of a charged object, which comprises:

a first metallic member for contacting the object to be discharged;

a second metallic member for contacting the ground;

a plurality of conductive elements in loose contact one with the other for establishing a resistive discharge path from said first to said second metallic member, wherein each of said conductive elements comprises:

a resistive element sandwiched between first and second conductive ceramic end pieces; each having an outwardly extending protuberance; and a rolled metal connector having a pair of opposed recesses for receiving and capturing the protuberances of the upstream and downstream ceramic end pieces.

6. Apparatus for the controlled discharge of a charged object, which comprises:

a first metallic member for contacting the object to be discharged;

a second metallic member for contacting the ground;

a plurality of conductive elements in loose contact one with the other for establishing a resistive discharge path from said first to said second metallic member, wherein each of said conductive elements comprises:

a ceramic resistance member having a pair of opposed cylindrical recesses therein, each of said recesses having a circumferential groove thereabout;

a metallic corona-ring connector having a pair of opposed extensions for being received within the corresponding recesses in said resistance members; each extension having a circumferential groove thereabout; and a non-conductive snap-ring for reception in the circumferential grooves in said resistance member and metallic connector thereby to lock one into the other.

7. The apparatus according to claim 6 wherein said metallic corona ring connector is a spark-gap connector and includes a pair of opposed annular recesses for receiving correspondingly shaped portions of the adjacent resistance members.

8. Apparatus for the controlled discharge of a charged object, which comprises:

a first metallic member for contacting the object to be discharged;

a second metallic member for contacting the ground;

a plurality of conductive elements in loose contact one with the other for establishing a resistive discharge path from said first to said second metallic member, wherein said conductive elements comprise ceramic discs and said apparatus further comprises:

a plurality of metallic voltage equalizer discs intermediate each n ceramic discs, $n > 1$; and a non-conductive elongated, cylindrical sheath around said ceramic discs and said voltage equalizer discs.

9. The apparatus according to claim 3 wherein said metallic spacers include a plurality of conductive elements to provide additional discharge paths to the atmosphere, prior to contact of said apparatus with the ground.

10. Apparatus for the controlled discharge of a charged object, which comprises:

a first metallic member for contacting the object to be discharged;

a second metallic member for contacting the ground;

a plurality of conductive elements in loose contact one with the other for establishing a resistive discharge path from said first to said second metallic member; and a variable series resistance comprising a plurality of fixed resistive elements and a plurality of variable resistance spark-gap elements sensitive to the impressed potential.

11. Apparatus for the controlled discharge of a charged object, which comprises:

a first metallic member for contacting the object to be discharged;

a second metallic member for contacting the ground;

a plurality of conductive elements in loose contact one with the other for establishing resistive discharge path from said first to said second metallic member;

a variable series resistance comprising a plurality of fixed resistive elements and a plurality of variable resistance spark-gap elements sensitive to the impressed potential, said potential sensitive variable resistance elements further comprise means for selectively switching in or out additional resistance elements.

12. The apparatus according to claim 11 wherein the variable resistance range $\Delta R_D$ is varied by contouring the spark-gap regions for different potential levels.

13. The apparatus according to claim 11 wherein said selective switching means comprises a plurality of resistors and a corresponding plurality of sensors, said resistors and sensors being connected in series-parallel arrangement.

14. The apparatus according to claim 4 wherein said metallic spacers include a plurality of conductive elements to provide additional discharge paths to the atmosphere, prior to contact of said apparatus with the ground.

15. The apparatus according to claims 1, 2 or 3 further comprising a variable series resistance comprising a plurality of fixed resistive elements and a plurality of variable resistance spark-gap elements sensitive to the impressed potential.

16. The apparatus according to claim 15 wherein said potential sensitive variable resistance elements further comprise means for selectively switching in or out additional resistance elements.

17. The apparatus according to claim 16 wherein the variable resistance range $\Delta R_D$ is varied by contouring the spark-gap regions for different potential levels.

18. The apparatus according to claim 16 wherein said selective switching means comprises a plurality of resistors and a corresponding plurality of sensors, said resistors and sensors being connected in series-parallel arrangement.

* * * * *